United States Patent [19]

Goleczka et al.

[11] Patent Number: 4,738,685

[45] Date of Patent: Apr. 19, 1988

[54] COAL BRIQUETTING PROCESS

[75] Inventors: Joseph Goleczka, Cheltenham; Walter Harris; John Pringle, both of Tewkesbury, all of England

[73] Assignee: Coal Industry (Patents) Limited, United Kingdom

[21] Appl. No.: 13,116

[22] Filed: Feb. 10, 1987

[30] Foreign Application Priority Data

Mar. 14, 1986 [GB] United Kingdom ..... 8606332

[51] Int. Cl.[4] ..... C10L 5/12

[52] U.S. Cl. ..... 44/15 B; 44/16 R; 44/16 C

[58] Field of Search ..... 44/15 B, 16 R, 16 C

[56] References Cited

U.S. PATENT DOCUMENTS 713,512 11/1902 Simons ..... 44/16 R
990,348 4/1911 Ellis et al. ..... 44/16 R
1,676,729 7/1928 Crocker ..... 44/16 R
1,994,378 3/1935 Williams et al. ..... 44/16 R
2,110,370 3/1938 Lum ..... 44/16 R
4,501,593 2/1985 Paersch et al. ..... 44/15 B

FOREIGN PATENT DOCUMENTS 21615 10/1902 United Kingdom ..... 44/16 C
229905 3/1925 United Kingdom ..... 44/16 R
230306 3/1925 United Kingdom .
222449 5/1925 United Kingdom .

*Primary Examiner*—Carl F. Dees
*Attorney, Agent, or Firm*—Stevens, Davis, Miller & Mosher

[57] ABSTRACT

Fine coal is cold briquetted using a binder which is 5–15% molasses and up to 5% of an inorganic hardening agent. An optional hot curing step gives water resistance. The briquettes show good strength characteristics and low undergrate losses during combustion.

13 Claims, No Drawings

COAL BRIQUETTING PROCESS

This invention concerns a coal briquetting process, and more especially it concerns a process for "cold" briquetting.

There exist many processes for briquetting fine coals in which the mixture fed to the briquetting press is hot, and various binders which melt at the operating temperature, such as pitch are used. In some cases, the coal itself, because it cakes at the operating temperature, forms or contributes to the binder. There is also interest in "cold" coal briquetting processes which require no heating or only heating to about 100° C. before briquetting. A binder must be used, therefore, which is effective at low temperatures, and many binders have been suggested. A problem faced especially by "cold" briquetting processes, is that the binders in the product briquettes may not provide adequate binding of the fine coal at or near the combustion temperature, resulting in partial or complete disintegration of the briquette and the loss of coal through the grate. This is termed "undergrate loss".

It is an aim of the present invention to provide a cold coal briquetting process producing briquettes which have adequate strength, which do not show excessive undergrate losses and utilising an inexpensive binder system which is tolerant of variations in the quantities of components and is not hazardous. Desirably, the briquettes exhibit good water resistance to prevent degradation during open air stocking.

Binders which are in use in the British Isles or have been suggested for cold briquetting processes include bitumen, starch and resin combinations, binders based on polyvinyl alcohol, e.g. PVA/calcium oxide (see No. GBP2138442), PVA/molasses (Europatent No. 0135784), PVA/calcium carbonate (Europatent No. 0135785) molasses and lime, molasses and phosphoric acid (GBP No. 230306) and binders based on sulphite lye, e.g. sulphite lye, sodium dichromate and sulphuric acid (Europatent No. 0127351). We have tested most and considered all of the above processes and their product briquettes, and we consider that most exhibit problems mitigating against large scale use and acceptability. For example, although the process disclosed in Europatent No. 0127351 yields strong briquettes which are waterproof, the ash volumes and undergrate losses tend to be high and the ash has an undesirably high concentration of chromium. Many users of solid fuel spread ashes and soot in their gardens, and high concentrations of heavy metals may follow from this practice. Molasses and lime binders give moderately strong briquettes but which have poor water resistance.

The present invention provides a cold coal briquetting process comprising mixing fine coal with a binder comprising 5–15% molasses and up to 5% of an inorganic hardening agent for the molasses selected from calcium carbonate, calcium phosphate, iron oxide and aluminium oxide, optionally together with an acid, all percentages being by weight of the mix, and briquetting the mix. This invention further provides briquettes formed using the process.

Preferred coals are high rank non-caking coals, especially those having low smoke emissions such as anthracite. Desirably the coal is of a particle size mainly below 3 mm, and anthracite duff is especially suitable. The invention is also applicable to coals for power stations or steam raising and to coal blends containing caking coal components and/or treated coals, e.g. by mild oxidation or by pyrolysis. The coal may be crushed or be the direct product of coal cutting.

Molasses is readily available at a much lower price than synthetic resins, and cane or beet molasses may be used.

The hardening agents calcium carbonate, calcium phosphate, ferric oxide and aluminium oxide, are readily available at low price in such forms as limestone, phosphate rock, bauxite and iron ore. These may be used alone or together in total amounts of 0.5 to 3%. Phosphoric acid or sulphuric acid may be used in amounts of up to 2% in admixture with any one or more of calcium phosphate, calcium carbonate, ferric oxide and aluminium oxide. Routine testing should, of course, be carried out to ensure that any individual coal/binder mix is satisfactory.

The briquetting step of the present invention includes all methods of forming agglomerates from fine coal, and these agglomerates may be of any size or shape according to market requirements. There may be mentioned forming agglomerates by extrusion, ringroll—or roll-pressing, die-pressing, rotary table pressing and pelletising, e.g. on a disc pelletiser.

The process preferably includes a hardening stage to permit the green briquettes to gain strength. The green briquettes harden over a period of 1 to 3 days at ambient temperature to give adequate crushing strengths, but the briquettes tend to have inadequate water resistance. However, the briquettes may be bagged in impervious sacks and allowed to further harden during storage. Preferably, however, a hot curing step is included to speed up the hardening stage and to make the briquettes water resistant, and this may be carried out at temperatures of the order of 200° to 300° C. for up to an hour. Hot curing may be conveniently carried out by passing the briquettes on a conveyor through an oven, in an inert or partially inert gas atmosphere which may contain any of nitrogen, carbon dioxide, water vapour and oxygen. It is to be noted that the hot curing step does not correspond to a carbonisation step, and thus not only are there energy savings, but the solid yield on a dry basis is very high. Additionally, there is a reduced risk of pollution.

The release of the green briquettes from the press moulds may be improved, if desired, by prewarming the moulds and/or by sprinkling coal fines or graphite uniformly across the press surface in contact with the mix prior to and during the briquetting of the mix.

The water resistance and appearance of the briquettes may be improved by an additional treatment with a spray or bath of a waterproofing agent. Several agents are known or have been proposed including, for example, aluminium acetate.

The presnt invention will now be described by way of example only.

EXAMPLE 1

A fine anthracite, from south Wales, was prepared by drying crushing and screening to −3 mm. The anthracite was admixed with 8% molasses, 1% limestone and 1% iron ore, by wt of the final composition, and was briquetted in a pilot plant roll-press. The green briquettes were cured at 250° C. for 1 hour under nitrogen and after cooling were found to have a 74 kg crushing strength. However, the briquettes were severely weakened after soaking for 24 hours in cold water.

EXAMPLE 2

The process described in Example 1 was repeated, but using 8% molasses and 2% iron ore as binder. Similar strengths, but improved water resistance were found.

EXAMPLE 3

The process described in Example 1 was repeated, but using 8% molasses, 1% iron ore and 1% phosphoric acid. A crushing strength of 115 kg was measured, and excellent water resistance was observed.

EXAMPLE 4

The process described in Example 1 was repeated, but using 10% molasses, 2% iron ore and 1% phosphoric acid. A crushing strength of 142 kg was measured and excellent water resistance was observed.

EXAMPLE 5

The process described in Example 1 was repeated, but using 8% molasses, 1% bauxite and 1% phosphoric acid. A crushing strength of 109 kg was measured, and excellent water resistance was observed.

EXAMPLE 6

In the preliminary laboratory tests, the fine anthracite as described in Example 1 was admixed with 8% molasses and either a mixture of 1% calcium carbonate and 1% ferric oxide or with 2% ferric oxide and briquetted using a mould-and-plunger press. After three days of open dry storage, the respective crushing strengths of the briquettes were 88 kg and 136 kg. However, no complete briquettes were found in either case after 24 hours immersion in water.

Combustion tests on the briquettes produced in Examples 3 and 4 were very encouraging and there were acceptable ash volumes and undergrate losses.

We claim:

1. A cold coal briquetting process comprising forming a mix of fine coal with a binder comprising 5–15% molasses and up to 5% of an inorganic hardening agent for the molasses selected from the group consisting of calcium carbonate, calcium phosphate, iron oxide and aluminium oxide, all percentages being by weight of the mix, and briquetting the mix.

2. A process as claimed in claim 1, wherein the coal is a high rank non-caking coal.

3. A process as claimed in claim 2, wherein the coal is anthracite duff.

4. A process as claimed in claim 1, wherein the coal is a power station or steam coal.

5. A process as claimed in claim 1, wherein the source of the hardening agent is selected from the group consisting of limestone, phosphate rock, iron ore and bauxite.

6. A process as claimed in claim 1, wherein the inorganic hardening agent is used in an amount of 1 to 3%.

7. The process as claimed in claim 1 wherein the hardening agent comprises additionally up to 2% of an acid selected from the group consisting of phosphoric acid and sulphuric acid.

8. A process as claimed in claim 1, and also comprising a briquette hardening stage.

9. A process as claimed in claim 1, and also comprising a hot curing step.

10. A process as claimed in claim 9, wherein the hot curing step comprises heating the briquettes at approximately 200° to 300° C. for up to an hour.

11. A coal briquette formed from a mix of fine coal and a binder comprising 5–15% molasses and up to 5% of a hardening agent for the molasses selected from the group consisting of calcium carbonate, iron oxide, aluminium oxide and calcium phosphate, all percentages being by weight of the mix.

12. A coal briquette as claimed in claim 11, wherein the source of the inorganic hardening agent is one or more members selected from the group consisting of limestone, iron ore, bauxite and phosphate rock.

13. A coal briquette as claimed in claim 11, wherein the hardening agent also comprises up to 2% of an acid selected from the group consisting of phosphoric acid and sulphuric acid.

* * * * *